United States Patent [19]

Jensen et al.

[11] Patent Number: 4,741,166

[45] Date of Patent: May 3, 1988

[54] LIQUIFIED GAS SUBCOOLER AND PRESSURE REGULATOR

[75] Inventors: Eric L. Jensen, Richmond; Harry W. Lee, Jr., Chesterfield County, both of Va.

[73] Assignee: Reynolds Metals Company, Richmond, Va.

[21] Appl. No.: 91,936

[22] Filed: Sep. 1, 1987

[51] Int. Cl.[4] ..... F17C 13/02

[52] U.S. Cl. ..... 62/49; 62/55

[58] Field of Search ..... 62/49, 55, 514 JT

[56] References Cited

U.S. PATENT DOCUMENTS

| | | | |
|---|---|---|---|
| 3,271,966 | 9/1964 | Webb | 62/45 |
| 3,440,829 | 4/1969 | Davies-White | 62/51 |
| 3,469,597 | 9/1969 | Bagnulo | 62/49 |
| 4,015,436 | 4/1977 | Seki | 62/48 |
| 4,373,357 | 2/1973 | Adams et al. | 62/514 JT |
| 4,407,340 | 10/1983 | Jensen et al. | 141/67 |
| 4,506,512 | 3/1985 | Delacour et al. | 62/49 |
| 4,510,760 | 4/1985 | Wieland | 62/49 |
| 4,607,489 | 8/1986 | Kvongold | 62/49 |

FOREIGN PATENT DOCUMENTS

| | | |
|---|---|---|
| 53-35678 | 4/1978 | Japan . |

*Primary Examiner*—Ronald C. Capossela
*Attorney, Agent, or Firm*—Alan T. McDonald

[57] ABSTRACT

An apparatus is disclosed for regulating a liquified gas input stream for temperature and pressure. The apparatus produces a pressurized head of liquified gas while removing gaseous material to produce a constant temperature and pressure liquified gas exit stream.

5 Claims, 2 Drawing Sheets

LIQUIFIED GAS SUBCOOLER AND PRESSURE REGULATOR

BACKGROUND OF THE INVENTION

Liquified inert gases are employed in many industrial processes. For example, U.S. Pat. No. 4,407,340 to the inventors of the present invention describes a system for injecting liquified inert gases into containers to pressurize these containers.

Liquified gases are supplied to industrial processes from either large pressurized storage tanks or portable pressurized tanks. In either event, transport of the liquified gas results in gaseous losses due to the inability to insulate transport pipes sufficiently to maintain the extremely cold temperatures at which these liquified gases remain in liquified form. Thus, a liquified gas stream as presented to an industrial process from its storage facility is in the form of a mixture of gas and liquid.

Since the amount of vaporization cannot be adequately controlled by insulation, the percent liquid, as well as the pressure of the liquified gas stream to the industrial process, varies considerably.

There is a need in many industrial processes to provide a gaseous free liquified gas stream to the process at a constant, known pressure.

THE PRESENT INVENTION

By means of the present invention, these desired goals are obtained.

The apparatus of the present invention takes as its input the combined gaseous and liquid output of a liquified gas storage facility, eliminates the gaseous component, subcools and pressurizes the liquid component sufficiently such that no gaseous component is present and provides this subcooled liquid component as its output at a constant pressure. The apparatus includes a chamber, a column descending from the chamber to create a head space of liquified gas, a tube surrounding the head space forming column to permit the gaseous component of the input stream to bleed off and a float mechanism to maintain balance in the system.

BRIEF DESCRIPTION OF THE DRAWINGS

The liquified gas subcooler and pressure controller of the present invention will be more fully described with reference to the drawings in which.

DETAILED DESCRIPTION OF THE PREFERRED EMBODIMENTS

Figure 1:
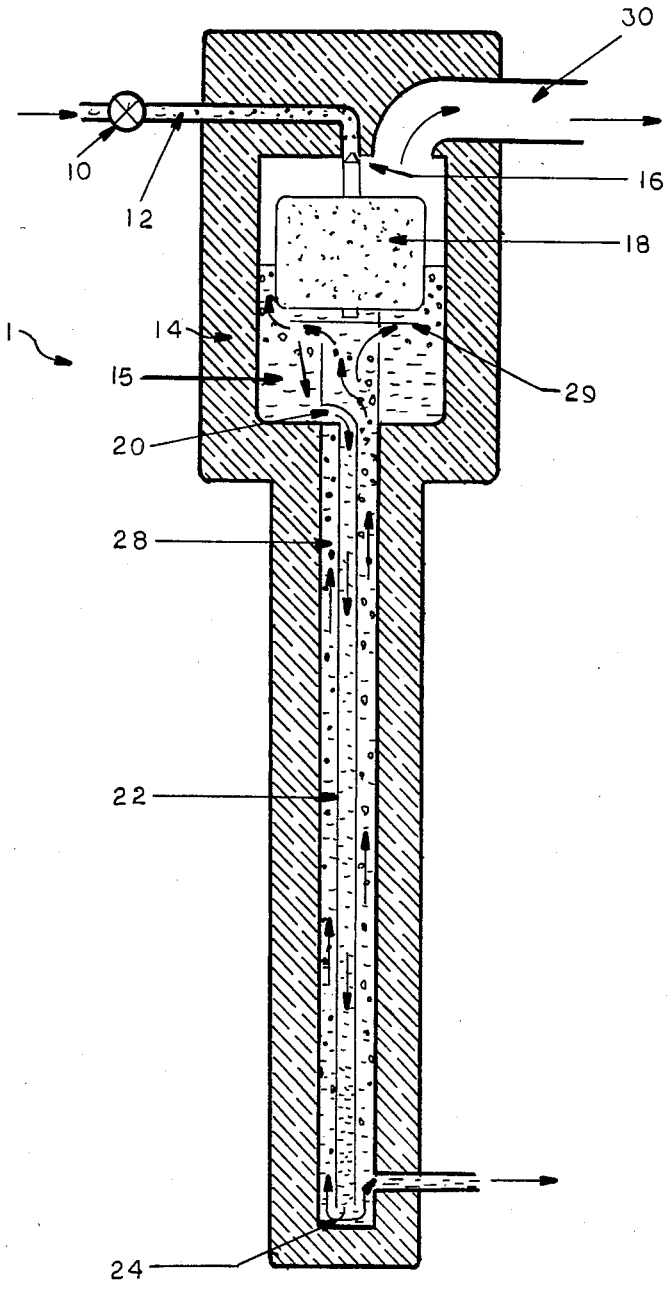
FIG. 1 is a cross-sectional view of the apparatus of the present invention according to a first embodiment thereof.

Turning now to the FIGURES, and especially to FIG. 1, the liquified gas subcooler and pressure regulator 1 of the present invention is illustrated. The operation of this apparatus will be described with reference to the use of liquid nitrogen as the input material, however, it should be realized that any liquified gas could be substituted for liquid nitrogen with the same operational results.

An inlet valve 10 is opened allowing liquid nitrogen being supplied from a supply source, such as a permanent or portable storage tank, to pass through valve 10 and inlet pipe 12, which inlet pipe 12 is controlled by valve stem 16. Liquid nitrogen enters chamber 15 and, through opening 20, column 22, bursting into gas and exiting through passageway 30 as it cools the internal parts down to a temperature of approximately −320° F. Liquid and gas continue to enter until the chamber 15 and column 22 reach this equilibrium temperature, at which point the liquid level in chamber 15 reaches a level sufficient to raise float 18 off of stop 29, closing the inlet with valve stem 16. Valve stem 16 will open and close inlet pipe 12 by the rising and falling of float 18 on demand as the liquid level drops either from evaporation of gas or use of liquid by the process being supplied.

Liquid nitrogen has the same physical characteristics as other volatile liquids, such as water; its boiling point is dependent on the absolute pressure on the liquid at any specific point. The boiling point of liquid nitrogen at atmospheric pressure is approximately −320.4° F. Its boiling point varies about 1.23° F. for each pound per square inch of pressure variation. That is, if the pressure is raised one pound per square inch, the boiling point of liquid nitrogen goes up to −319.1° F. The boiling point in a tank of liquid increases as the depth of liquid increases. Using liquid nitrogen at a density of 50.46 pounds per cubic foot, the pressure increases one pound per square inch for every 34.2 inches of liquid head. Therefore, the boiling point of liquid nitrogen increases 0.036° F. for each inch that the depth of the liquid increases.

The operation of the apparatus 1 is dependent upon the variation in boiling point with pressure. The liquid in the chamber 15 is at approximately atmospheric pressure and is at a temperature of −320.4° F. The liquid at the bottom opening 24 of column 22 is at a pressure higher than that in the chamber 15 due to the static head space. For example, if the height of the column of liquid nitrogen is approximately 35 inches, the static head raises the boiling point of the liquid nitrogen 1.23° F. The liquid in outer tube 28 surrounding column 22 is constantly absorbing heat even though both it and chamber 15 are surrounded by insulation material 14. As the liquid in outer tube 28 rises, it gains more heat which produces bubbles of gas. It is these bubbles that power the apparatus of the present invention. As these bubbles rise up outer tube 28, they force circulation of the liquid in outer tube 28 and down column 22. As the liquid rises in tube 28, it is moving to an area of reducing pressure. Therefore, its boiling point drops. The temperature of the liquid drops, caused by more liquid boiling to vapor, which removes heat from the liquid. When liquid reaches the top of outer tube 28, its temperature is reduced to the atmospheric boiling point of −320.4° F. and is by volume about 5% to 10% vapor.

The rising of the liquid in outer tube 28 must be replaced with liquid from inner column 22. This liquid from chamber 15 cannot gain any significant amount of heat because it is surrounded by boiling liquid nitrogen at almost the same temperature. The heat gain of the liquid nitrogen in chamber 15 is limited by the temperature difference between the temperature in column 22 and tube 28, which at any one point is less than about 0.5° F. Assuming that the liquid in column 22 were to be heated to the temperature of tube 28, no more heating can occur because there is no temperature differential. No heat can flow if there is no temperature differential. As the liquid nitrogen flows down column 22, it becomes subcooled because its temperature remains approximately constant and its pressure is increasing due to the head of liquid above it. The liquid is not cooled but its boiling point is raised by the increasing head pressure as it moves down column 22. Any liquid is considered subcooled when its temperature is below the saturated liquid temperature related to its absolute pressure. This makes it impossible for any liquid in column 22 to turn to vapor. Therefore, it is possible to supply 100% liquified gas at a uniform pressure through outlet 26.

The boiling of the liquified gas in tube 28 produces a moderately violent circulation of subcooled liquid flow down column 22, assuring an adequate supply of subcooled liquid at outlet 26. The pressure at the outlet 26 is very close to the theoretical head expected from the liquid surface to the bottom 24 of column 22. The difference from theoretical is due to the flow friction in column 22 and uncertainty of the liquid surface location because of the moderate circulation of the liquid.

As is readily apparent from the description, the apparatus 1 is self-regulating, with the only moving part being the float 18. The pressure at exit 26 is determined by the height of the column 22 of liquid. Thus, the apparatus may be designed having column 22 of any desired height to produce the proper constant output pressure at outlet 26.

Figure 2:
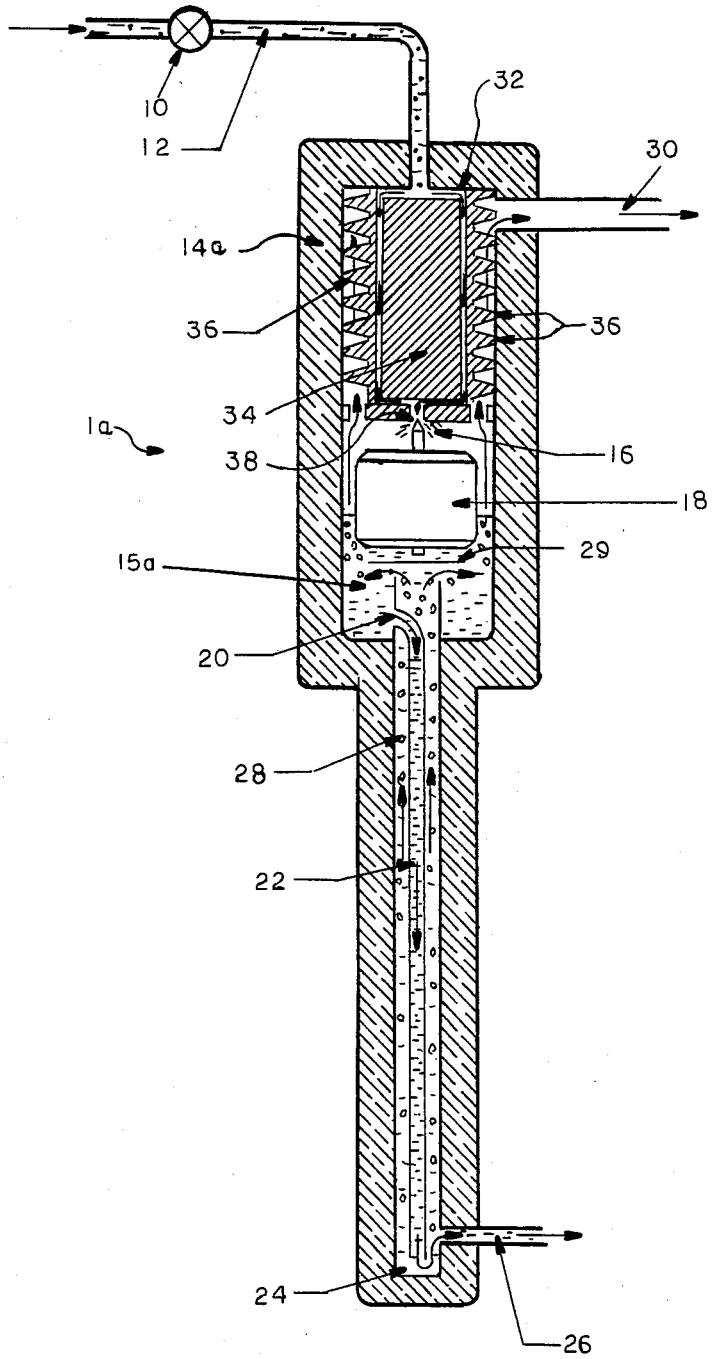
FIG. 2 is a cross-sectional view of the apparatus of the present invention according to a second embodiment thereof.

FIG. 2 illustrates a slightly modified version 1*a* of the apparatus. The only difference is the addition of heat exchanger 34. In this case, the inlet pipe 12 is not in direct connection with valve stem 16. Rather, the liquid-gas mixture passes through a passageway 32 in a heat exchanger 34, which heat exchanger is cooled through its fins 36 by the rising gas exiting through passageway 30. This heat exchanger 34 has an exit point 38 which is controlled by valve stem 16 in the same manner as described above. Using the evaporating gas to pre-cool the liquid-gas mixture produces less evaporating gas and thus improves the efficiency of the system.

From the foregoing, it is clear that the present invention provides a simple yet effective means for both subcooling and regulating the pressure of a liquified gas input to provide pure liquified gas at a constant temperature and pressure.

While the invention has been described with reference to certain specific embodiments thereof, it is not intended to be so limited thereby, except as set forth in the accompanying claims.

We claim:

1. An apparatus for subcooling a liquified gas from a source of said liquified gas and for providing a constant stream of subcooled liquified gas at a preselected pressure comprising a chamber, an inlet line in fluid flow connection with said chamber and said source of liquified gas, float means within said chamber for controlling fluid flow from said inlet line, a column positioned beneath said chamber having its upper end in fluid flow connection with said chamber and having its lower end in fluid flow connection with an outlet line, said column having a height selected to provide said preselected pressure, a tube surrounding said column having its upper end in fluid flow connection with said chamber and having its lower end in fluid flow connection with the lower end of said column and a gas exhaust in fluid flow connection with said chamber.

2. The apparatus of claim 1 wherein said apparatus is enclosed within thermal insulation.

3. The apparatus of claim 1 further comprising stop means within said chamber to maintain said float means above said tube.

4. The apparatus of claim 1 further comprising a heat exchanger in fluid flow connection between said inlet line and said chamber.

5. The apparatus of claim 1 wherein said liquified gas is liquid nitrogen.

* * * * *